US005497740A

United States Patent [19]

Thiemeier

[11] Patent Number: 5,497,740

[45] Date of Patent: Mar. 12, 1996

[54] CERAMIC VALVE FOR INTERNAL COMBUSTION ENGINES HAVING A REDUCED TENDENCY TO STRESS FRACTURE

[75] Inventor: Thomas Thiemeier, Hattersheim am Main, Germany

[73] Assignee: Hoechst Aktiengesellschaft, Frankfurt am Main, Germany

[21] Appl. No.: 290,784

[22] PCT Filed: Feb. 11, 1993

[86] PCT No.: PCT/EP93/00331

§ 371 Date: Sep. 2, 1994

§ 102(e) Date: Sep. 2, 1994

[87] PCT Pub. No.: WO93/18282

PCT Pub. Date: Sep. 16, 1993

[30] Foreign Application Priority Data

Mar. 7, 1992 [DE] Germany ..... 42 07 213.1

[51] Int. Cl.[6] ..... F01L 3/10

[52] U.S. Cl. ..... 123/188.13; 123/90.67; 251/322

[58] Field of Search ..... 123/188.12, 188.13, 123/90.65, 90.67; 251/322

[56] References Cited

U.S. PATENT DOCUMENTS

| | | | |
|---|---|---|---|
| 941,314 | 11/1909 | Evan | 123/90.67 |
| 3,978,830 | 9/1976 | Toth, Jr. | 123/90.67 |
| 4,592,313 | 6/1986 | Speckhart | 123/90.65 |
| 5,275,376 | 1/1994 | Rich | 123/90.67 |

FOREIGN PATENT DOCUMENTS

| | | | |
|---|---|---|---|
| 0249503 | 12/1987 | European Pat. Off. . | |
| 0419543 | 1/1911 | France . | |
| 0553538 | 5/1923 | France . | |
| 224410 | 12/1984 | Japan | 123/188.13 |

*Primary Examiner*—Erick R. Solis
*Attorney, Agent, or Firm*—Foley & Lardner

[57] ABSTRACT

The invention concerns a ceramic valve for internal combustion engines whose spring retainer is frictionally linked to the valve stem, and whose cylindrical valve stem (2) is surrounded by a collet (3) having a conical outer profile (4). The spring retainer (5) provided with a conical bore (6) rests on the collet (3).

5 Claims, 1 Drawing Sheet

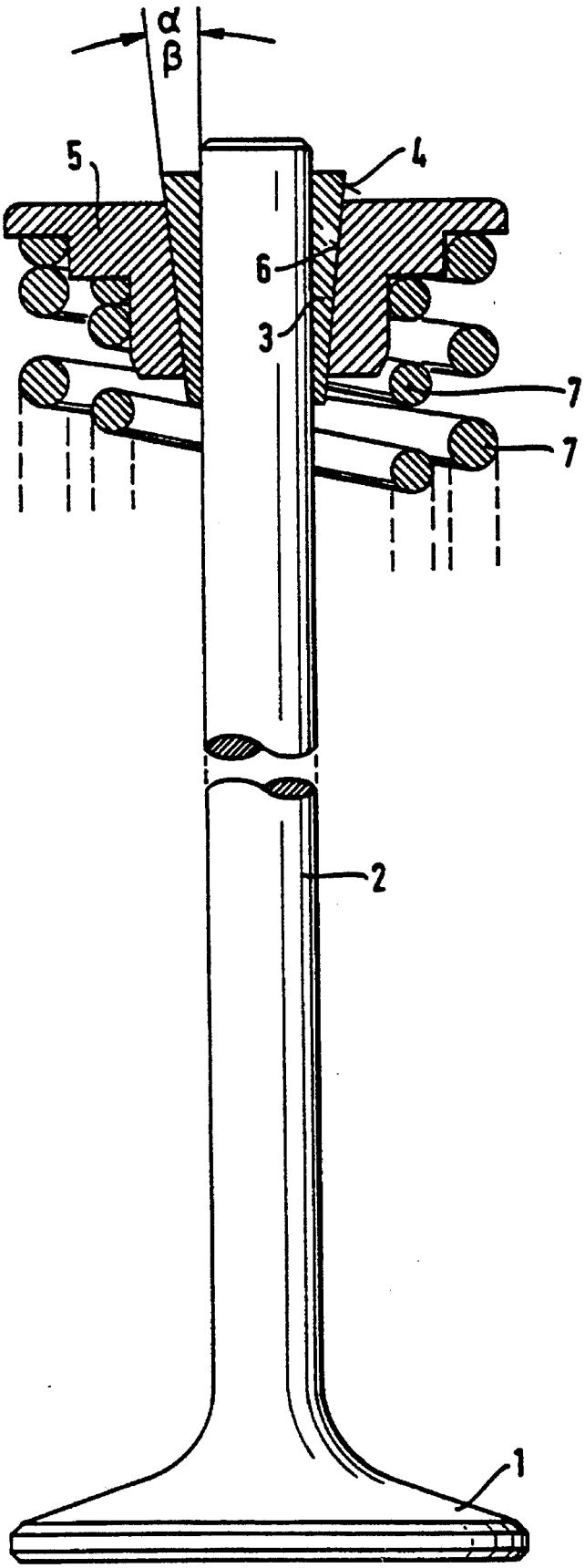
α
β
5
4
6
3
7
7
2
1

CERAMIC VALVE FOR INTERNAL COMBUSTION ENGINES HAVING A REDUCED TENDENCY TO STRESS FRACTURE

BACKGROUND OF THE INVENTION

The invention concerns a ceramic valve for internal combustion engines whose spring retainer is frictionally linked to the valve stem.

Ceramic engine valves are known from EP-A-0249503. From this, the valve stem is provided with an annular groove at the connecting location to the spring retainer and is surrounded by a longitudinally split collet with a conical outer profile. On its inner wall, the collet has a protuberance which engages in the groove of the valve stem. The spring retainer has a conical bore which interacts with the conical outer wall of the collet so as to provide a positive connection. In order to avoid partial stress cracks in the region of the groove in the valve stem, a soft metal coating is provided at least between the collet and the valve stem. The coating alleviates stress fractures in the cylindrical part of the valve stem but not in the region of the groove. The invention is intended to provide a remedy in this respect.

SUMMARY OF THE INVENTION

The invention achieves the object by means of a cylindrical valve stem which is surrounded by a collet having a conical outer profile on which the conical bore of the spring retainer rests.

The conicity of the outer profile of the collet and of the bore of the spring retainer can be between 0.5° and 15°,in particular between 2° and 6°. The collet can be provided with longitudinal slots or can be split.

Valve stem fractures which are caused by the notch effect of the groove or stress concentrations due to geometrical shortcomings of the groove and/or of the collet protuberances are avoided by means of the invention.

In addition, fractures due to surface damage, which arises during the manufacture of complicated stem shapes, are avoided.

The valve stem, which has an undisturbed cylindrical shape in the region of the spring retainer (i.e. it has a constant circular cross section), is surrounded by a collet with a cylindrical inner profile and a conical outer profile. The spring retainer rests on the collet by means of its conical bore which matches the collet. The diameter of the collet is compressed by the spring retainer and collet clamping together in such a way that the cylindrical joint between the collet and the valve stem is clamped. This permits the introduction by friction into the valve stem of the forces acting at the spring retainer.

BRIEF DESCRIPTION OF THE DRAWINGS

The FIGURE shows an elevational view in partial cross section of a ceramic engine valve according to the present invention.

DETAILED DESCRIPTION OF THE INVENTION

The invention is explained in more detail below using the drawing, which shows only one way of executing it.

The FIGURE shows a ceramic engine valve, substantially without valve spring and partially sectioned. The valve head 1 and the valve stem 2 are manufactured in one piece from ceramic material, for example silicon nitride or silicon carbide. A collet 3 with a conical outer profile 4 is pushed onto the free end of the valve stem 2. The spring retainer 5 rests, by means of its conical bore 6, on the conical outer profile 4. The conicity $\alpha$ of the outer profile of the collet and $\beta$ of the bore of the spring retainer has an angle of between 0.5° and 15°, in particular between 2° and 6°. In order reliably to avoid concentrations in the introduction of force into the valve stem at the ends of the collet, it can be expedient to dimension the collet in such a way that it protrudes at both ends of the bore. The spring which holds the valve in the closed position (not shown) is indicated by 7.

I claim:

1. A ceramic valve for internal combustion engines having a spring retainer provided with a conical bore frictionally linked to a cylindrical valve stem, wherein said cylindrical valve stem has a constant circular cross section, and is surrounded by a collet having a conical outer profile on which the spring retainer provided with a conical bore rests.

2. A valve as claimed in claim 1, wherein the conicity of the outer profile of the collet and of the bore of the spring retainer is between 0.5° and 15°.

3. A valve as claimed in claim 2, wherein the conicity of the outer profile of the collet and of the bore of the spring retainer is between 2° and 6°.

4. A valve as claimed in claim 1, wherein said collet protrudes beyond the bore of the spring retainer at both ends of said bore.

5. A valve as claimed in claim 1, wherein said cylindrical valve stem is not provided with a groove along the outer surface of said valve stem and said collet is not provided with a projection on the inner surface of said collect.

* * * * *